US007869743B2

(12) United States Patent
Kagawa et al.

(10) Patent No.: US 7,869,743 B2
(45) Date of Patent: Jan. 11, 2011

(54) IMAGE FORMING APPARATUS, PROCESS CARTRIDGE USED THEREIN, AND PRODUCTION METHOD OF CHARGING ROLLER

(75) Inventors: Toshiaki Kagawa, Kitakatsuragi-gun (JP); Kouji Shinkawa, Kitakatsuragi-gun (JP); Tohru Sakuwa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 832 days.

(21) Appl. No.: 11/790,288

(22) Filed: Apr. 24, 2007

(65) Prior Publication Data

US 2007/0253740 A1 Nov. 1, 2007

(30) Foreign Application Priority Data

Apr. 28, 2006 (JP) ..... 2006-127062
Apr. 19, 2007 (JP) ..... 2007-111009

(51) Int. Cl.
*G03G 15/02* (2006.01)

(52) U.S. Cl. ..... 399/176; 399/174

(58) Field of Classification Search ..... 399/174, 399/176

See application file for complete search history.

(56) References Cited

U.S. PATENT DOCUMENTS 3,998,185 A * 12/1976 Weiler ..... 399/265
5,110,705 A * 5/1992 Hosoya et al. ..... 399/285
5,483,330 A 1/1996 Ogiyama et al.
5,701,560 A * 12/1997 Tsujita et al. ..... 399/56
5,842,086 A * 11/1998 Honma et al. ..... 399/159
6,263,175 B1 * 7/2001 Sawada et al. ..... 399/176
6,458,444 B1 * 10/2002 Natsuhara et al. ..... 399/335
2001/0055687 A1 12/2001 Hoshi
2003/0039494 A1 * 2/2003 Shakuto et al. ..... 399/357
2004/0022558 A1 * 2/2004 Okano et al. ..... 399/175
2004/0265006 A1 12/2004 Taniguchi et al.
2005/0058464 A1 * 3/2005 Azami et al. ..... 399/30
2005/0163518 A1 7/2005 Onose et al.

FOREIGN PATENT DOCUMENTS

JP 5-216352 A 8/1993
JP 5-281830 10/1993
JP 9-62057 A 3/1997
JP 10063089 A * 3/1998
JP 11015181 A * 1/1999

(Continued)

OTHER PUBLICATIONS

English Abstract of JP 10063089 A to Isoda et al.*

(Continued)

*Primary Examiner*—Ryan D Walsh
(74) *Attorney, Agent, or Firm*—Nixon & Vanderhye, PC

(57) ABSTRACT

An image forming apparatus in which a charging roller charges an image carrier to which a lubricant is applied prevents slip of the charging roller. The charging roller is composed of a metal core and a rubber layer mainly made of an epichlorohydrin rubber formed around the metal core. A surface of this rubber layer is hardened with a surface treating solution containing an isocyanate compound. The surface of this rubber layer is also subjected to three abrading processes including two stone grinding processes and one lapping process so that a ten-point height of irregularities Rz thereof becomes 11 μm or more.

13 Claims, 4 Drawing Sheets

FOREIGN PATENT DOCUMENTS

| | | | |
|---|---|---|---|
| JP | 2000-346051 | | 12/2000 |
| JP | 2001-348443 | | 12/2001 |
| JP | 2002-82514 | | 3/2002 |
| JP | 2002-91232 | A | 3/2002 |
| JP | 2002-278252 | A | 9/2002 |
| JP | 2002-278262 | | 9/2002 |
| JP | 2003-202731 | A | 7/2003 |
| JP | 2004-191960 | | 7/2004 |
| JP | 2004-191961 | | 7/2004 |
| JP | 2004-309910 | A | 11/2004 |
| JP | 2005-37931 | A | 2/2005 |
| JP | 2005-121934 | A | 5/2005 |
| JP | 2005-164873 | A | 6/2005 |
| JP | 2005-189509 | | 7/2005 |
| JP | 2005-208577 | A | 8/2005 |
| JP | 2006-053544 | | 2/2006 |

OTHER PUBLICATIONS

English Abstract of JP 11015181 A to Sakamoto.*

* cited by examiner

IMAGE FORMING APPARATUS, PROCESS CARTRIDGE USED THEREIN, AND PRODUCTION METHOD OF CHARGING ROLLER

This nonprovisional application claims priority under 35 U.S.C. §119(a) on Patent Application No. 127062/2006 and No. 111009/2007 filed in Japan respectively on Apr. 28, 2006 and Apr. 19, 2007, the entire contents of which are hereby incorporated by reference.

FIELD OF THE TECHNOLOGY

The present technology relates to a charging roller, provided in an electrophotographic image forming apparatus, which contacts an image carrier on which an electrostatic latent image is to be formed, to electrically charge the image carrier.

BACKGROUND OF THE TECHNOLOGY

In electrophotographic image formation, an electrostatic latent image that corresponds to the image is formed on a photoreceptor surface. An electric charging process, in which the photoreceptor surface is uniformly charged, is needed prior to the formation of the electrostatic latent image. The photoreceptor can be charged by one of two schemes: the non-contact charge scheme and the contact charge scheme.

The non-contact charge scheme involves the use of a so-called "corotron charger", a so-called "scorotron charger" or the like. These chargers induce corona discharge, which in turn supplies electric charge to the photoreceptor through the air. Since the charger does not contact the photoreceptor in the non-contact charge scheme, the photoreceptor is less likely to be contaminated or wear out, which are advantages of the scheme. On the other hand, the scheme has a problem that the corona discharge entails ozone and other byproducts.

A recent trend which has emerged due to consideration of the environment is contact chargers which do not involve any corona discharge. Some of them employ a rubber member to contact the photoreceptor. The member is shaped like a roller, and voltage is applied to it. The roller that includes the rubber member is generally called a charging roller.

Document 1 discloses an arrangement in which a ten-point height of irregularities Rz of a surface of a charging roller is set to 10 μm or less. This arrangement is intended to stably remove deposits from the surface thereof for a long term and to sufficiently suppress the occurrence of poor charging or uneven charging. Document 1 also discloses an arrangement in which a lubricant such as a zinc stearate is applied to the photoreceptor, in the image forming apparatus using this charging roller. The lubricant is applied to improve performance of cleaning a residual toner on the photoreceptor after image-transfer and to prevent wear-out of the photoreceptor.

Documents 2 to 9 disclose a technology of subjecting a rubber member of a charging roller to surface processing. The technology disclosed in these documents modifies (hardens) a surface of the rubber member made of an epichlorohydrin rubber base material by treating the surface with an isocyanate compound. This modification makes it possible to prevent, for example, an ionic conductive agent from seeping from the surface, without an additional layer formation around the rubber member.

Document 1: Japanese Unexamined Patent Publication No. 189509/2005 (Tokukai 2005-189509) (published on Jul. 14, 2005)

Document 2: Japanese Unexamined Patent Publication No. 281830/1993 (Tokukaihei 5-281830) (published on Oct. 29, 1993)

Document 3: Japanese Unexamined Patent Publication No. 346051/2000 (Tokukai 2000-346051) (published on Dec. 12, 2000)

Document 4: Japanese Unexamined Patent Publication No. 348443/2001 (Tokukai 2001-348443) (published on Dec. 18, 2001)

Document 5: Japanese Unexamined Patent Publication No. 40760/2002 (Tokukai 2002-40760) (published on Feb. 6, 2002)

Document 6: Japanese Unexamined Patent Publication No. 82514/2002 (Tokukai 2002-82514) (published Mar. 22, 2002)

Document 7: Japanese Unexamined Patent Publication No. 191960/2004 (Tokukai 2004-191960) (published on Jul. 8, 2004)

Document 8: Japanese Unexamined Patent Publication No. 191961/2004 (Tokukai 2004-191961) (published on Jul. 8, 2004)

Document 9: Japanese Unexamined Patent Publication No. 53544/2006 (Tokukai 2006-53544) (published on Feb. 23, 2006)

SUMMARY OF THE TECHNOLOGY

However, the conventional charging roller tends to slip when the conventional charging roller charges a photoreceptor on which a lubricant such as a zinc stearate is applied. If the charging roller slips in charging the photoreceptor, an uncharged part is produced in a region of the photoreceptor where the charging roller has not come to contact with the photoreceptor due to the slip. As a result, a black streak is produced in an image formed.

A slip of the charging roller conspicuously occurs particularly when a processing speed is high, for example, 280 mm/sec, or when a large amount of a lubricant is applied to the photoreceptor. Moreover, when only a direct current constant voltage is applied to the charging roller, controllability of a charging voltage applied to the photoreceptor is inferior to that in a case where a direct current constant voltage and an alternate current voltage are applied. Accordingly, in a case where only a direct current constant voltage is applied, a defective image becomes conspicuous due to the slip.

This technology is attained in view of the problems mentioned above. An object of the technology is to prevent a slip of a charging roller in an image forming apparatus in which the charging roller charges an image carrier on which a lubricant is applied.

An image forming apparatus, in order to solve the problem mentioned above, is characterized by including: an image carrier to which a lubricant is applied; and a charging roller including a rubber layer whose surface contacts the image carrier, wherein the surface of the rubber layer has a ten-point height of irregularities Rz of 11 μm or more.

The "ten-point height of irregularities Rz" is the one defined in JIS-B-0601-1994.

The charging roller included in an image formation apparatus has a surface whose ten-point height of irregularities Rz is larger than that of a conventional charging roller. By making the surface of the rubber layer rougher than that of the conventional rubber layer, it is possible to increase friction (gripping force) between the charging roller and the image carrier. Moreover, in the image forming apparatus, when viewed at the micro level, a rougher surface of the rubber layer of the charging roller reduces a contact area between the charging roller and the image carrier, to which surface the lubricant is applied. This also makes it possible to reduce the amount of the lubricant transferred to the surface of the rubber layer from the image carrier. As a result, a slip of the charging roller can be significantly suppressed.

Note that this technology includes a process cartridge, which is attached to the image forming apparatus, including at least the image carrier and the charging roller.

A production method of a charging roller including a rubber layer whose surface contacts an image carrier to which a lubricant is applied includes: a step of subjecting a surface of the rubber layer to stone grinding, and a step of subjecting the surface of the rubber layer to lapping after the stone grinding step so that the surface of the rubber layer has a ten-point height of irregularities Rz of 11 μm or more and a maximum height of the profile Rmax of less than 25.8 μm.

According to the arrangement mentioned above, it is possible to produce a charging roller which is less likely to cause a slip and a fog.

Additional objects, advantages and novel features of the technology will be set forth in part in the description which follows, and in part will become apparent to those skilled in the art upon examination of the following or may be learned by practice of the technology.

DESCRIPTION OF THE EMBODIMENTS

Embodiment

The following will describe an embodiment of the present technology with reference to FIGS. 1 to 6.

Figure 2:
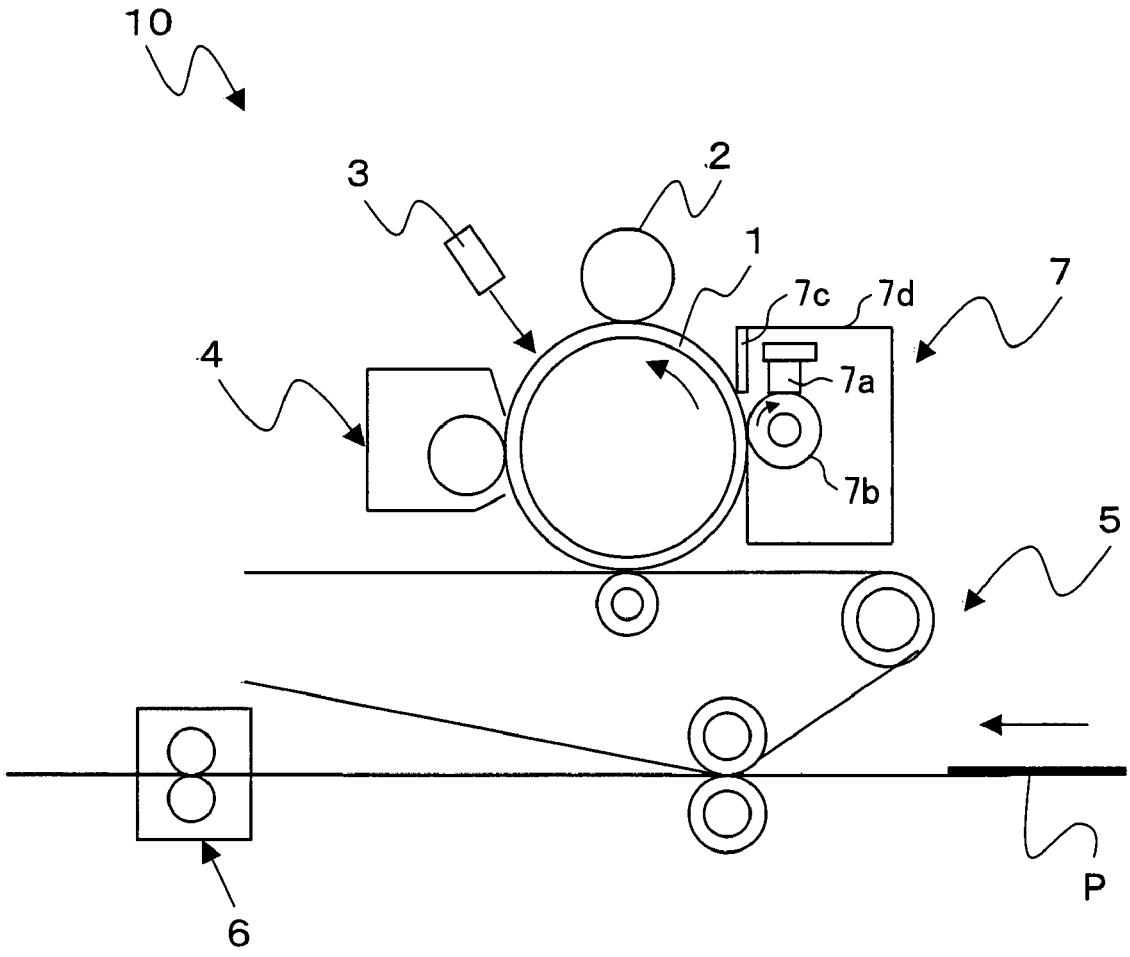
FIG. 2 is a cross-sectional view illustrating an overall structure of an image forming apparatus.

Referring to FIG. 2, the structure of major features of an image forming apparatus 10 of the present embodiment will be described. FIG. 2 is a vertical cross-sectional view of the image forming apparatus 10 when viewed from the front.

As shown in FIG. 2, the image forming apparatus 10 forms an image represented by image data on a sheet of paper by an electrophotographic scheme. The image forming apparatus 10 contains a photoreceptor (image carrier) 1. Around the photoreceptor 1 are there provided components which perform a well-known Carlson process: namely, a charging roller 2, illumination unit 3, developing unit 4, transfer unit 5, fusing unit 6, and cleaning unit 7.

The photoreceptor 1 is shaped like a drum and supported at its axis by a housing (not shown) in such a way that it is rotatable. The photoreceptor 1 contains a support body having a photosensitive layer being formed on its surface. The support body is made of, for example, an aluminum-based material. The layer is made of, for example, an OPC (organic photoconductor). The drum-shaped photoreceptor 1 may be replaced with a belt-shaped photoreceptor.

The charging roller 2 contacts the surface of the photoreceptor 1 to uniformly charge the surface of the photoreceptor 1 to a desired electric potential. The roller is shaped like a roller. The charging roller 2 is supported at its axis by a housing (not shown) in such a way that it is rotatable. The structure of the charging roller 2 will be described later in detail.

The illumination unit 3 may be an ELD (electroluminescent display), LED (light emitting diode), or like write head in which light emitting elements are arranged in an array. Alternatively, the unit 3 may be a laser scanning unit (LSU) which is equipped with a laser emitting device and a reflection mirror. The illumination unit 3 illuminates the photoreceptor 1 in accordance with the externally supplied image data to form an electrostatic latent image in accordance with the image data on the photoreceptor 1.

The developing unit 4 visualizes (develops) the electrostatic latent image formed on the surface of the photoreceptor 1 with toner, thereby forming a toner image. The transfer unit 5 includes a rotating endless belt supported by a plurality of rollers. In the transfer unit 5, the toner image is transferred first from the photoreceptor 1 to the endless belt and then from the endless belt to paper. A toner image is thus formed on the paper.

The fusing unit 6 presses the paper onto which the toner image has been transferred with a heated roller from both sides of the paper, to fuse the toner image onto the paper.

The cleaning unit 7 cleans the surface of the photoreceptor 1 after the toner image transfer. The cleaning unit 7 contains a lubricant 7*a*, a brush roller 7*b*, and a blade 7*c*, all of which are housed in an enclosure 7*d*.

The blade 7*c* collects the remaining toner on the surface of the photoreceptor 1. The blade 7*c* is made of an elongated rubber member and positioned so that its length is parallel to the axis of the photoreceptor 1. The blade 7*c* is placed so that one of the long sides is located downstream of an opening provided on the enclosure 7*d* in terms of the rotation of the photoreceptor 1 and that the edge of the other long side is in contact with the surface of the photoreceptor 1.

The lubricant 7*a* is applied to the surface of the photoreceptor 1 by the brush roller 7*b*. The lubricant 7*a* is a solid type and has a rectangular parallelepiped shape. The lubricant 7*a* has the same length (width) as the photoreceptor 1 and is positioned so that its length is parallel to the axis of the photoreceptor 1. The lubricant 7*a* is supported by a lubricant holder. The lubricant 7*a* is replaceable if it wears down.

The lubricant 7*a* may be, for example, a metal salt of a fatty acid, known as metal soap, or fluorine resin. Examples of metal salts of fatty acids include zinc stearate, copper stearate, iron stearate, magnesium palmitate, zinc oleate, calcium palmitate, manganese oleate, lead oleate, and other like metal salts of fatty acids with a relatively long chain.

The brush roller 7*b* is tubular and has almost the same length (width) as the photoreceptor 1. The roller 7*b* is positioned with its axis parallel to that of the photoreceptor 1 so that the tips of the brush hair touch the surface of the photoreceptor 1. The brush roller 7*b* is driven to rotate in the opposite direction to the photoreceptor 1. Thus, the roller 7*b* and the photoreceptor 1 slide against each other in the same orientation where they are in contact.

The contact between the brush roller 7*b* and the photoreceptor 1 occurs downstream of the transfer site in terms of the rotation of the photoreceptor 1. The brush roller 7*b* therefore contacts the surface of the photoreceptor 1 from which the toner image has been already transferred. The brush roller 7*b* scrapes the lubricant 7*a* located upstream of its contact with the photoreceptor 1 in terms of the rotation of the brush roller 7*b*, and applies the scraped lubricant to the surface of the photoreceptor 1.

By applying the fine particles in the lubricant 7*a* to the surface of the photoreceptor 1 as above, the brush roller 7*b* lowers the friction between the blade 7*c* and the surface of the photoreceptor 1 and the adhesion of the toner to the surface of the photoreceptor 1. As a result, the blade 7*c* is capable of efficiently removing the toner and eases the wearing of the photoreceptor 1.

In the image forming apparatus of the present embodiment, the photoreceptor 1 and the charging roller 2 may be provided detachably. That is, the above image forming apparatus may be realized by integrally forming at least the photoreceptor 1 and the charging roller 2 as a process cartridge (process apparatus) and attaching this process cartridge to the image forming apparatus.

Figure 3:
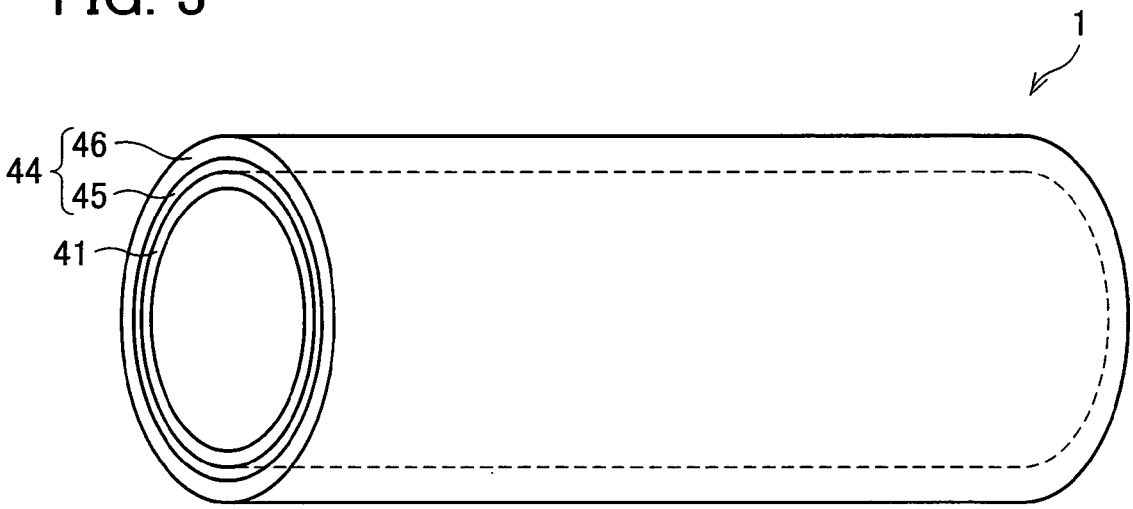
FIG. 3 is an oblique view illustrating a structure of a photoreceptor.

Now, the structure of the photoreceptor 1 will be described in detail. In the present embodiment, the photoreceptor 1 has a drum shape as shown in FIG. 3 and is made up of a support body 41 and a photosensitive layer 44 formed on the surface of the support body 41.

The support body 41 holds the photosensitive layer 44. The support body 41 may be (a) a metal material, such as aluminum, an aluminum alloy, copper, zinc, stainless steel, or titanium, (b) a polymer material, such as polyethylene terephthalate, polyester, polyoxymethylene, or polystyrene, hard paper, or glass which have its surface laminated with metal foil, which have a metal material vapor-deposited on the surface, or which have a layer of a conductive compound, such as an electrically conductive polymer, tin oxide, indium oxide, carbon particles, or metal particles, vapor-deposited or applied to the surface.

Figure 4:
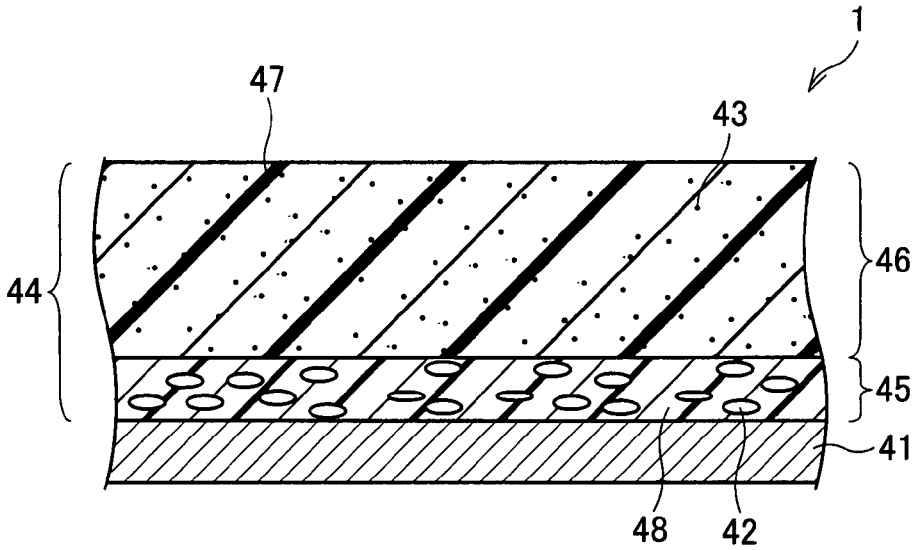
FIG. 4 is a cross-sectional view illustrating an internal structure of the photoreceptor.

The photosensitive layer 44 is made up, for example, an OPC (organic photoconductor). As shown in FIG. 3, the layer 44 contains in it a charge generating layer 45 and a charge transport layer 46 in this order when viewed from the support body 41. The charge generating layer 45 produces electric charge under light. The charge generating layer 45, as shown in FIG. 4, contains a charge generating material (CGM) 42 which produces electric charge by absorbing light and a binder resin 48 which binds the charge generating material 42.

The charge transport layer 46 receives the charge generated by the charge generating layer 45 and transports it to the surface of the photoreceptor 1. The charge transport layer 46, as shown in FIG. 4, contains a charge transport material (CTM) 43 which transports electric charge and a binder resin 47 which binds the charge transport material 43.

Accordingly, if the photosensitive layer 44 is irradiated with light, electric charge is generated in the irradiated part of the charge generating layer 45. The generated charge is transported to the surface of the photosensitive layer 44 by the charge transport layer 46. As a result, the surface charge of the photosensitive layer 44 is cancelled, thereby forming an electrostatic latent image.

The charge generating material 42 is preferably a substance which produces electric charge under light with wavelengths from 400 to 800 nm. Specific examples include azo compounds, such as bisazo compounds and trisazo compounds; phthalocyanine compounds; squarylium compounds; azulenium compounds; perylene compounds; indigo compounds; polycyclic quinone compounds of quinacridone compounds; cyanine pigments; xanthene dyes; and charge moving complexes, such as poly-N-vinyl carbazole and trinitrofluorenon. These compounds may be used in any combination of two or more of them where necessary. The ratio of the charge generating material 42 to the charge generating layer 45 is preferably 20 to 80% by weight.

The charge transport material 43 may be, for example, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an oxazolone derivative, a benzimidazole derivative, a quinazoline derivative, a benzofuran derivative, an acridine derivative, a phenazine derivative, an amino stilbene derivative, a triallylamine derivative, a phenylenediamine derivative, a stilbene derivative, a benzidine derivative, poly-N-vinyl carbazole, poly-1-vinylbilene, or poly-9-vinyl anthracene. These compounds may be used in any combination of two or more of them where necessary. The ratio of the charge transport material 43 to the charge transport layer 46 is preferably 20 to 80% by weight.

The binder resins 47, 48 are, for example, only one resin selected from the group comprising various resins, such as a polyester resin, a polystyrene resin, a polyurethane resin, a phenol resin, an alkyd resin, a melamine resin, an epoxy resin, a silicone resin, an acrylic resin, a methacrylic resin, a polycarbonate resin, a polyarylate resin, a phenoxy resin, a polyvinyl butyral resin, and a polyvinyl formal resin, and copolymer resins containing two or more repeat units of these resins. Alternatively, the binder resins 47, 48 may be two or more resins selected from that group which are used in mixture form. Further, the binder resins 47, 48 may also be, for example, an insulating copolymer resin, such as a vinyl chloride-vinyl acetate copolymer resin, a vinyl chloride-vinyl acetate-maleic anhydride copolymer resin, or an acrylonitrile-styrene copolymer resin.

The photoreceptor 1 is manufactured as follows. The support body 41 is immersed in a charge generating layer solution which contains the charge generating material 42, the binder resin 48, and an organic solvent for the materials so that the solution is applied to the support body 41. The organic solvent is evaporated to form the charge generating layer 45. Then, the support body 41 is immersed in a charge transport layer solution which contains the charge transport material 43, the binder resin 47, and an organic solvent for the materials so that the solution is applied to the support body 41. The organic solvent is evaporated to form the charge transport layer 46.

Figure 1:
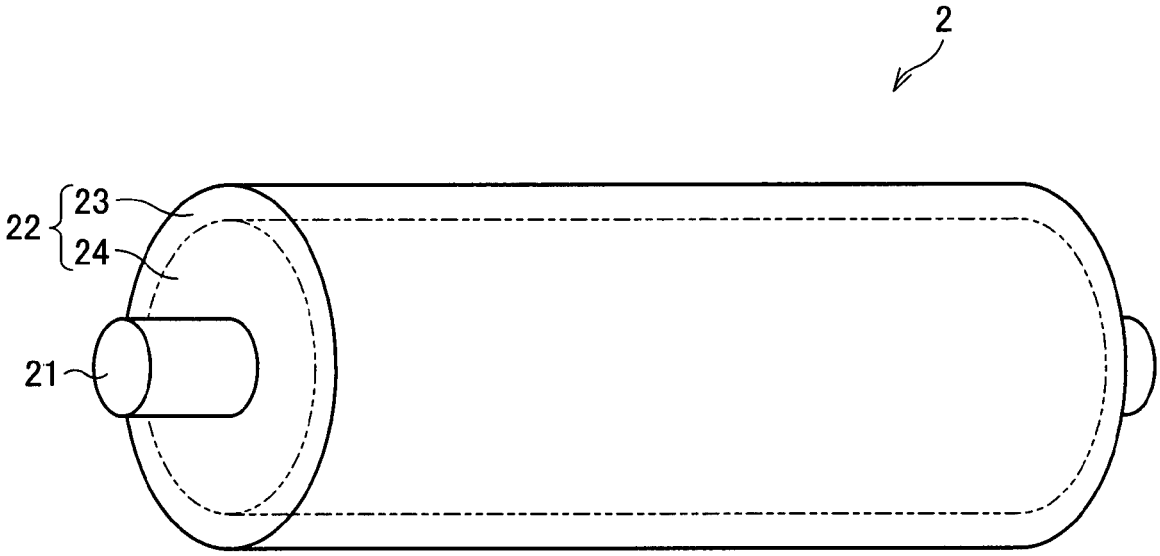
FIG. 1 is an oblique view illustrating a structure of a charging roller.

Next, the structure of the charging roller 2 will be described in detail. In the present embodiment, the charging roller 2 is shaped like a roller as shown in FIG. 1 and made of a columnar metal core 21 and a rubber layer 22 formed around the core 21. The rubber layer 22 contains a surface processed portion 23 and a non-surface processed portion 24. In the rubber layer 22, the processed portion 23 is located on the surface layer side, and the non-processed portion 24 is located on the metal core 21 side.

The metal core 21 is, for example, stainless steel (SUS) or another electrically conductive metal molded into a bar. A direct current constant voltage is applied to the metal core 21 when the photoreceptor 1 is charged.

The rubber layer 22 around the metal core 21 is formed from a composition that includes as a base material an epichlorohydrin rubber of either any one or any blend of polymers selected from epichlorohydrin homopolymer, epichlorohydrin-ethylene oxide copolymer, epichlorohydrinallyl glycidyl ether copolymer, and epichlorohydrin-ethylene oxide-allyl glycidyl ether terpolymer.

An electronic conductive agent or ionic conductive agent may be added to the epichlorohydrin rubber base material. With the addition of the conductive agent, the resistance of the rubber layer 22 can be adjusted to a desired value. The electronic conductive agent added to the rubber base material is, for example, fine powder of: an electrically conductive carbon, such as carbon black, carbon graphite, or carbon nanotube; or an oxide of a metal, such as tin, zinc, or antimony. The ionic conductive agent added to the rubber base material is, for example: an ammonia complex salt or a perchloride of a metal, such as Li, Na, K, Ca, or Mg; sodium acetate trifluoride; or a quaternary ammonium salt. Apart from the rubber base material and the various conductive agents, the rubber layer 22 may also contain a vulcanization accelerator and a crosslinking agent.

The rubber base material containing the various additives is impregnated with a surface processing solution by applying the solution to that material. Then, the material is heated to form the processed portion 23 on the rubber layer 22. The surface processing solution may be applied by any general method, for example, by spraying or dipping. The inside portion of the rubber layer 22, not impregnated with the surface processing solution, is the non-processed portion 24. The processed portion 23 and the non-processed portion 24 have no distinct interface. The surface processing prevents the ionic conductive agent, as an example, from seeping from the rubber layer 22 and contaminating the photoreceptor.

The surface processing solution can be a mixture of an isocyanate compound, an acrylic fluorine-based polymer, an acrylic silicone-based polymer and a conductive agent such as carbon black. The isocyanate compound is, for example, 2,6-tolylenediisocyanate (TDI), 4,4'-diphenylmethanediisocyanate (MDI), paraphenylenediisocyanate (PPDI), 1,5-naphthalenediisocyanate (NDI), or 3,3-dimethyldiphenyl-4,4'-diisocyanate (TODI), as well as a multimer or denatured substance of these compounds.

The acrylic fluorine-based polymer and the acrylic silicone-based polymer can be any polymer that is soluble in a predetermined solvent and that forms chemical bonding with the isocyanate compound through reaction. Specifically, the acrylic fluorine-based polymer is a fluorine-based polymer that is soluble in the solvent and that contains a hydroxyl group, an alkyl group, or a carboxyl group. Some of the examples are block copolymers of acrylic esters and fluoroalkyl acrylate and their derivatives. The acrylic silicone-based polymer is a silicone-based polymer that is soluble in a solvent. Some of the examples are block copolymers of acrylic esters and acrylic siloxane esters and their derivatives.

It is to be noted that the rubber layer 22 of the charging roller 2 of the present embodiment has an appropriate surface roughness. More specifically, the surface of the rubber layer 22 has a ten-point height of irregularities Rz of 11 μm or more, which is rougher than that of a conventional rubber layer.

By making the surface of the rubber layer 22 rougher than that of the conventional rubber layer, it is possible to increase friction (gripping force) between the charging roller 2 and the photoreceptor 1. Moreover, in the image forming apparatus 10 of the present embodiment, when viewed at the micro level, a rougher surface of the rubber layer 22 of the charging roller 2 reduces a contact area between the charging roller 2 and the photoreceptor 1. This also makes it possible to reduce the amount of the lubricant 7*a* transferred to the rubber layer 22 from the photoreceptor 1, which lubricant 7*a* is applied to the surface of the charging roller 2. As a result, a slip of the charging roller 2 can be significantly suppressed.

It is preferable that the surface of the rubber layer 22 has a ten-point height of irregularities Rz of less than 20 μm. When the surface roughness of the rubber layer 22 is too large, the charging roller 2 unevenly charges the photoreceptor 1. Accordingly, a small spot strongly charged is produced on the photoreceptor 1. As a result, a fog occurs in a formed image. If the ten-point height of irregularities Rz of the surface of the rubber layer 22 is suppressed to less than 20 μm, it becomes possible to prevent a fog, as illustrated in the Examples explained later.

Moreover, for the purpose of preventing a fog, a maximum height of the profile Rmax of the surface of the rubber layer 22 may be arranged to be less than 25.8 μm, instead of arranging the surface of the rubber layer 22 so that the ten-point height of irregularities Rz becomes less than 20 μm. The uneven charging that causes the fog is, in practice, produced by protrusions on the surface of the rubber layer 22. Therefore, the uneven charging is greatly influenced by a maximum height of the profile of the surface of the rubber layer 22. Therefore, it is possible to prevent the fog by suppressing the maximum height of the profile Rmax to 25.8 μm or less. If the maximum height of the profile Rmax of the surface of the rubber layer 22 is suppressed to less than 25.8 μm, it is possible to prevent the fog even when the ten-point height of irregularities Rz of the surface of the rubber layer 22 is a little larger than 20 μm, as described later in Examples.

Figure 5:
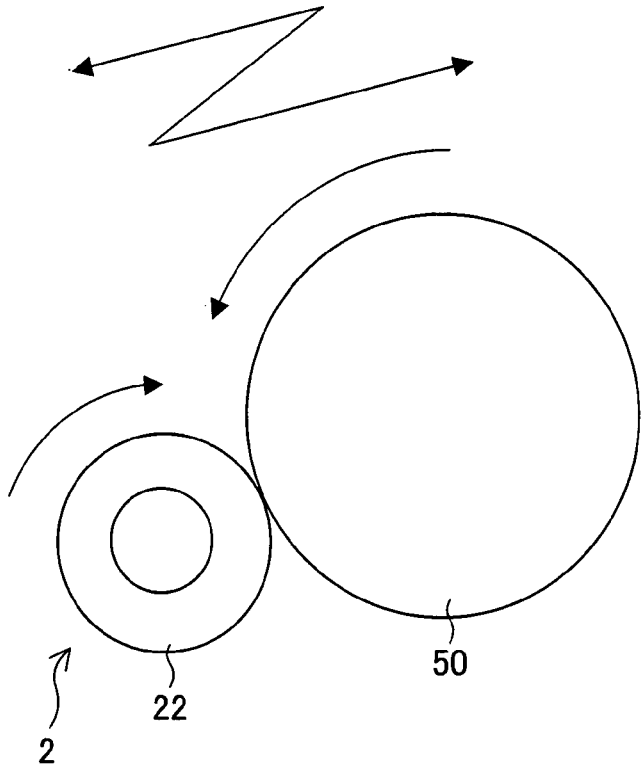
FIG. 5 is an explanatory diagram illustrating one abrading process for adjustment of a surface roughness of the charging roller.

In order to arrange the surface of the rubber layer so that the ten-point height of irregularities Rz becomes 11 μm or more and the maximum height of the profile Rmax becomes less than 25.8 μm, it is preferable to carry out three abrading processes in the following procedure. First, a conventional stone grinding is performed as a first abrading process. In this stone grinding process, as illustrated in FIG. 5, a periphery surface of a grindstone 50 which has a disc shape is brought into contact with a surface of the rubber layer 22 of the charging roller 2. Then, the grindstone 50 and the charging roller 2 are driven to rotate in directions opposite to each other. During the rotation, the grindstone 50 is moved back and forth in a longitudinal direction (in a direction parallel to a rotation axis) of the charging roller 2. In this manner, the rubber layer 22 of the charging roller 2 is subjected to rough abrading.

Next, a second abrading process is carried out with the use of a grindstone finer than the grindstone used in the first abrading process. This can reduce the ten-point height of irregularities Rz of the surface of the rubber layer 22 and the maximum height of the profile Rmax of the same.

Figure 6:
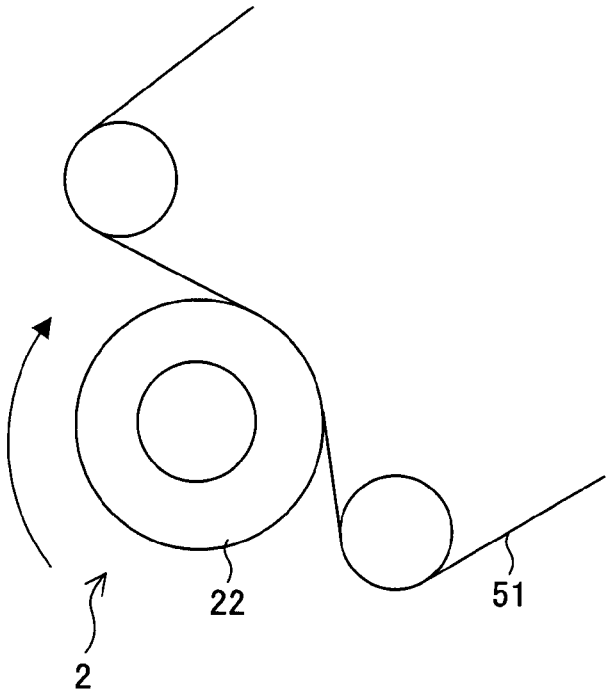
FIG. 6 is an explanatory diagram illustrating another abrading process for adjustment of a surface roughness of the charging roller.

In the present embodiment, lapping is performed lastly as a third abrading process. In this lapping, as illustrated in FIG. 6, the rubber layer 22 and a tool (lap) 51 are slid so as to rub each other, in a state where an abrasive made of dispersed loose abrasive particles intervenes between the rubber layer 22 of the charging roller 2 and the tool 51. For example, (i) fine powder of diamond, silicon carbide, alumina, or the like, or (ii) abrasive particles of silicon oxide, cerium oxide, zirconia, chromium oxide, or the like hydrophilic oxide are used for the lapping. This makes it possible to practically reduce only the maximum height of the profile Rmax while substantially maintaining the ten-point height of irregularities Rz of the surface of the rubber layer 22.

Note that a method of the abrading process is not limited to the method mentioned above. However, for example, polishing may be used as the abrading process.

When a charging roller is ground, only first and second stone grinding processes are carried out conventionally among the three abrading processes mentioned above. However, in the present embodiment, lapping is further added to the conventional abrading processes. This makes it possible to reduce only the maximum height of the profile Rmax while substantially maintaining the ten-point height of irregularities Rz.

It is preferable that the surface of the rubber layer 22 has a JIS-A hardness of 35° or less. When the surface of the rubber layer 22 has a high hardness, a slip between the charging roller 2 and the photoreceptor 1 tends to occur. However, as illustrated in the Examples explained later, by arranging the surface of the rubber layer 22 so that a hardness becomes 35° or less, the charging roller 2 and the photoreceptor 1 can sufficiently grip each other even under a small load applied. As a result, it becomes possible to suppress the occurrence of a black streak. Reduction of the rubber hardness is particularly effective in (i) a case where the processing speed is high, for example, 280 mm/s or more, (ii) a case where an applied voltage is a direct current constant voltage, or (iii) a case where a large amount of a lubricant such as zinc stearate is applied to the photoreceptor 1.

It is preferable that the following equation (1) is satisfied, $$D/W<45 \quad (1)$$

where W is a nip width (width in a rotating direction) between the rubber layer 22 and the photoreceptor 1 and D is an external diameter of the rubber layer 2.

D/W shows a length of an external diameter of the charging roller 2 per unit length of the nip width. The larger the nip width is, the larger contact area between the charging roller 2 and the photoreceptor 1 becomes. Therefore, the larger nip width makes it possible to reduce an occurrence of a slip. However, the larger the diameter of the charging roller 2 becomes, the larger inertia force of the charging roller 2 during rotation becomes. As a result of this, a slip is likely to occur. Accordingly, as in the Examples explained later, if the nip width W is set so that D/W becomes less than 45, it becomes possible to preferably prevent the slip regardless of a diameter of the charging roller 2.

As illustrated above, in the present embodiment, a voltage applied to the charging roller 2 during image formation is a direct current constant voltage. Such application of the direct current constant voltage during image formation for uniformly charging the photoreceptor 1 is advantageous to reducing an occurrence of byproducts such as ozone. However, when a direct current constant voltage is used as a voltage applied to the charging roller 2, controllability of a voltage charging the photoreceptor 1 becomes inferior to that in a case where a direct current constant voltage and an alternate current voltage are applied, for the following reason. When a direct current constant voltage and an alternate current voltage are applied, discharge and opposite discharge are repeated between the photoreceptor 1 and the charging roller 2. This leads to an effect that a surface voltage of the photoreceptor 1 is converged into a constant voltage. This effect cannot be obtained only with a direct current constant voltage. As a result, a defective image becomes conspicuous due to the slip in a case where only a direct current constant voltage is applied. However, a surface roughness of the rubber layer 22 is adjusted in the charging roller 2 of the present embodiment as mentioned above. This can prevent the occurrence of a slip and a black streak caused by the slip. A voltage applied during other times than image formation, for example, during rotation of the charging roller before or after image formation, is not limited to a direct current constant voltage. The applied voltage may be a voltage produced by a voltage obtained by superimposing an alternate current upon a direct current voltage, or the like.

In the image forming apparatus 10 of the present embodiment, the photoreceptor 1 and the charging roller 2 driven along with the photoreceptor 1 can be driven to rotate at a circumferential speed of 280 mm/sec or more. If the photoreceptor 1 and the charging roller 2 are driven to rotate at the rotation speed mentioned above, a processing speed of the image forming apparatus (image formation processing speed) becomes at least 280 mm/sec. As a result, a high-speed processing becomes possible. In general, such an increase in processing speed is likely to cause a slip between the charging roller 2 and the photoreceptor 1. However, the charging roller 2 of the present embodiment, which is arranged to have a surface roughness of the rubber layer 22 as mentioned above, prevents the occurrence of a slip and a black streak caused by the slip.

EXAMPLES

Next, explained are Examples performed in order to verify effectiveness of the present technology.

Experiment 1

In the present experiment, image formation was performed by charging rollers 2 with variations in hardness of a surface of a rubber layer 22 and a ten-point height of irregularities Rz of the same. Then, it was examined whether or not a black streak or a fog occurred in an image formed. Consequently, this experiment clarified a relationship between a ten-point height of irregularities Rz of the surface of the rubber layer 22 and the occurrence of a black streak or a fog.

In this experiment, the metal core 21 was a SUS bar 8 mm in diameter. The rubber base material for the rubber layer 22 was an epichlorohydrin rubber. The rubber layer 22 was obtained by kneading an electronic conductive agent that contained carbon black as a primary component and an ionic conductive agent that contained lithium perchlorate as a primary component into the rubber base material. Then, the rubber layer 22 that contained the ionic conductive agent was formed around the metal core 21 to fabricate a pseudo charging roller 12. A value of a rubber hardness was adjusted for each of the Examples and the Comparative Examples by the amount of a rubber softening agent (paraffin oil) added. Specifically, a hardness (JIS-A hardness) of a surface of the rubber layer 22 was set to 39° in the Comparative Examples 1-1, 1-2, and 1-3, and the Example 1-4. The hardness was set to 35° in the Examples 1-1, 1-3, and 1-5, and the Comparative Example 1-4. Moreover, the hardness was set to 31° in the Example 1-2.

The surface of the rubber layer 22 of the pseudo charging roller 12 was subjected to above-mentioned two stone grinding processes and, then, above-mentioned one lapping process in this order, so that the external diameter of the rubber layer 22 became 21 mm. In the abrading processes mentioned above, a roughness of abrasive particles used in abrading and abrading time were adjusted so that the pseudo charging roller 12 having a different ten-point height of irregularities Rz was produced for the use in each of the Examples and the Comparative Examples. Specifically, a ten-point height of irregularities Rz (JIS B 0601-1994) of the surface of the rubber layer 22 was set to: 8.7 μm in the Comparative Example 1-1; 9 μm in the Comparative Example 1-2; 9.3 μm in the Comparative Example 1-3; 11.4 μm in the Example 1-1; 13.8 μm in the Examples 1-2, 1-3, and 1-4; 17.6 μm in the Example 1-5; and 20 μm in the Comparative Example 1-4. The ten-point height of irregularities Rz was measured with a tracer-type surface roughness tester (Surfcorder SE-30H, Surface Roughness Measuring Instrument, manufactured by Kosaka Laboratory Ltd.).

Next, the pseudo charging roller 12 was impregnated with a surface treatment liquid by spraying it on the pseudo charging roller 12 with the use of a spray. The surface treatment liquid contained an isocyanate compound, acrylic fluorine-based polymer and acrylic silicone-based polymer. Then, the firing treatment was carried out with respect to the pseudo charging roller 12. Thus, the surface treatment was carried out with respect to the pseudo charging roller 12. As a result, the charging roller 2 was manufactured.

Used as the supporting body 41 of the photoreceptor 1 was an aluminium tube having a surface roughness (JIS B 0601-1982 maximum height of the profile) Rmax of 3 μm and a diameter of 80 mm. Prepared as an electric charge generating layer liquid that was a material of the electric charge generating layer 45 of the photoreceptor 1 was a liquid containing the following.

Y type oxo-titanyl phthalocyanine (produced by SYNTEC, Electric charge generating material). 1 part by weight Polyvinylbutyral (produced by Sekisui Chemical Co., Ltd., Product Name: S-LEC BMS, Binder resin). 1 part by weight Methyl ethyl ketone (Organic solvent). 98 parts by weight Moreover, prepared as an electric charge transporting layer liquid that was a material of the electric charge transporting layer 46 was a liquid containing the following.

Styryl based compound (Electric charge transporting material) shown by the following structural formula 100 parts by weight (Chemical Formula 1)

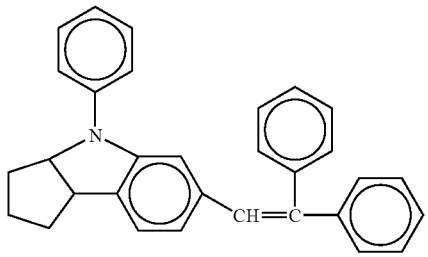

Polycarbonate resin (produced by Teijin Chemicals, Ltd., Product Name: C1400, Viscosity average molecular weight: 38,000, Binder resin). 100 parts by weight Methyl ethyl ketone (Organic solvent). 800 parts by weight Silicone oil (produced by Toray Dow Corning Silicone Co., Ltd., Product Name: SH200, Additive). 0.02 parts by weight Then, the supporting body 41 was soaked in the respective layer liquids for applying the liquids thereto, and the organic solvent was evaporated. Thus, the photosensitive layer 44 was formed.

The charging roller 2 was arranged so as to be in contact with the photoreceptor 1 and apply a load of 500 gf (equal to approximately 4.9N) to the photoreceptor 1. Then, image formation was performed on a sheet of paper at a processing speed of 395 mm/sec while a direct current voltage was applied to the charging roller 2. During the image formation, a lubricant made of zinc stearate was applied to the photoreceptor 1 at 30 μg/A4 (30 μg per one sheet of A4 sized paper whereon an image was formed). Then, it was examined by visual observation whether or not a black streak and a fog had occurred.

As a result, as illustrated in Table 1 below, a black streak occurred in an image formed in the Comparative Examples 1-1, 1-2, and 1-3. Moreover, a black streak slightly occurred in the Example 1-1. However, no black streak occurred in the Examples 1-2, 1-3, 1-4, and 1-5, and the Comparative Example 1-4. On the other hand, a fog occurred only in the Comparative Example 1-4. In the Examples and Comparative Examples other than the Comparative Example 1-4, no fog occurred.

TABLE 1

| | CHARGING ROLLER | | | |
|---|---|---|---|---|
| | RUBBER HARDNESS (DEGREE) | SURFACE ROUGHNESS (μm) | BLACK STREAK | FOG |
| COMPARATIVE EXAMPLE 1-1 | 39 | 8.7 | BAD | GOOD |
| COMPARATIVE EXAMPLE 1-2 | 39 | 9 | BAD | GOOD |
| COMPARATIVE EXAMPLE 1-3 | 39 | 9.3 | BAD | GOOD |
| EXAMPLE 1-1 | 35 | 11.4 | FAIR | GOOD |
| EXAMPLE 1-2 | 31 | 13.8 | GOOD | GOOD |
| EXAMPLE 1-3 | 35 | 13.8 | GOOD | GOOD |
| EXAMPLE 1-4 | 39 | 13.8 | GOOD | GOOD |
| EXAMPLE 1-5 | 35 | 17.6 | GOOD | GOOD |
| COMPARATIVE EXAMPLE 1-4 | 35 | 20 | GOOD | BAD |

In the "BLACK STREAK" column in Table 1, "GOOD" indicates that no black streak occurred at all. "FAIR" indicates that a black streak occurred slightly. "BAD" indicates that a black streak occurred. In the "FOG" column, "GOOD" indicates that no fog occurred at all. "BAD" indicates that a fog occurred.

In production of a charging roller 2 used in this experiment, a charging roller 2 having a high hardness of 39° and a large ten-point height of irregularities of 20 μm, for example, was not fabricated. This is because the charging roller 2 having a high hardness was easily ground and therefore difficult to constantly have a large ten-point height of irregularities Rz of the surface of such a charging roller 2. Similarly, a charging roller 2 having a low hardness of 31° and a small ten-point height of irregularities of 10 μm, for example, was not fabricated. This is because it was difficult to grind the charging roller 2 having a low hardness, and the charging roller 2 was therefore difficult to constantly have a small ten-point height of irregularities Rz of the surface of such a charging roller 2.

The results obtained from the Experiment explained above suggest the followings as to the surface of the rubber layer 22 of the charging roller 2. For the purpose of preventing the occurrence of a black streak, it is preferable that the ten-point height of irregularities Rz is set to 11 μm (more precisely 11.4 μm) or more. It is more preferable that the ten-point height of irregularities Rz is set to 13 μm (more precisely 13.8 μm) or more. Moreover, for the purpose of preventing the occurrence of a fog, it is preferable that the ten-point height of irregularities Rz is set to less than 20 μm.

Experiment 2

Next, a relationship between (i) an external diameter of a charging roller 2 relative to a nip width and (ii) the occurrence of a black streak was examined by using charging rollers 2 and photoreceptors 1 which were produced in the same method as in the Experiment 1. In this Experiment, each of the charging rollers 2 having various surface hardnesses was arranged so as to be in contact with the photoreceptor 1 under various loads. Then, image formation was performed on a sheet of paper at a processing speed of 395 mm/sec while a direct current constant voltage was applied to the charging roller 2. Then, it was examined by visual observation whether or not a black streak had occurred in an image formed. During the image formation, a lubricant made of zinc stearate is applied to the photoreceptor 1 at 30 μg/A4. For this experiment, three charging rollers 2 of different external diameters and three photoreceptors 1 of different external diameters were prepared. With the use of the charging rollers 2 and the photoreceptors 1 prepared, a common trend was examined under various external diameter conditions.

Specific conditions for this Experiment were as follows. First, in all the Examples and the Comparative Examples of this Experiment, a ten-point height of irregularities of the charging roller 2 was fixed at 13.8 μm. An external diameter of the charging roller 2 was set to 21 mm and an external diameter of the photoreceptor 1 was set to 80 mm in the Comparative Examples 2a-1 and 2a-2, and the Examples 2a-1, 2a-2, 2a-3, 2a-4, and 2a-5. An external diameter of the charging roller 2 was set to 18 mm and an external diameter of the photoreceptor 1 was set to 60 mm in the Comparative Examples 2b-1 and 2b-2, and the Examples 2b-1, 2b-2, 2b-3, 2b-4, and 2b-5. Moreover, an external diameter of the charging roller 2 was set to 14 mm and an external diameter of the photoreceptor 1 was set to 30 mm in the Comparative Examples 2c-1, and the Examples 2c-1, 2c-2, 2c-3, 2c-4, 2c-5, and 2c-6. Tables 2 through 4 below show a rubber hardness (JIS-A hardness), an applied load, a nip width, and a value of roller diameter/nip width in each of Examples and Comparative Examples.

As a result, as shown in the Tables 2 through 4, a black streak occurred when a value of roller diameter/nip width was equal to or more than 45, whereas no black streak occurred when the value was less than 44 (more precisely equal to or less than 43.8).

TABLE 2

Charging Roller ϕ21 mm, Photoreceptor ϕ80 mm

| | CHARGING ROLLER | | | | |
|---|---|---|---|---|---|
| | RUBBER HARDNESS (DEGREE) | APPLIED LOAD (gf) | NIP WIDTH (mm) | ROLLER DIAMETER/NIP WIDTH | BLACK STREAK |
| COMPARATIVE EXAMPLE 2a-1 | 39 | 240 | 0.4 | 52.5 | BAD |
| COMPARATIVE EXAMPLE 2a-2 | 35 | 240 | 0.37 | 56.8 | BAD |
| EXAMPLE 2a-1 | 31 | 240 | 0.48 | 43.8 | GOOD |
| EXAMPLE 2a-2 | 39 | 500 | 0.57 | 36.8 | GOOD |
| EXAMPLE 2a-3 | 35 | 500 | 0.63 | 33.3 | GOOD |
| EXAMPLE 2a-4 | 31 | 500 | 0.69 | 30.4 | GOOD |
| EXAMPLE 2a-5 | 39 | 1000 | 0.8 | 26.3 | GOOD |

TABLE 3

Charging Roller ϕ18 mm, Photoreceptor ϕ60 mm

| | CHARGING ROLLER | | | | |
|---|---|---|---|---|---|
| | RUBBER HARDNESS (DEGREE) | APPLIED LOAD (gf) | NIP WIDTH (mm) | ROLLER DIAMETER/NIP WIDTH | BLACK STREAK |
| COMPARATIVE EXAMPLE 2b-1 | 39 | 240 | 0.36 | 50.0 | BAD |
| COMPARATIVE EXAMPLE 2b-2 | 35 | 240 | 0.4 | 45.0 | BAD |
| EXAMPLE 2b-1 | 31 | 240 | 0.44 | 40.9 | GOOD |
| EXAMPLE 2b-2 | 39 | 500 | 0.52 | 34.6 | GOOD |
| EXAMPLE 2b-3 | 35 | 500 | 0.57 | 31.6 | GOOD |
| EXAMPLE 2b-4 | 31 | 500 | 0.63 | 28.6 | GOOD |
| EXAMPLE 2b-5 | 39 | 1000 | 0.74 | 24.3 | GOOD |

TABLE 4

Charging Roller ϕ14 mm, Photoreceptor ϕ30 mm

| | CHARGING ROLLER | | | | |
|---|---|---|---|---|---|
| | RUBBER HARDNESS (DEGREE) | APPLIED LOAD (gf) | NIP WIDTH (mm) | ROLLER DIAMETER/NIP WIDTH | BLACK STREAK |
| COMPARATIVE EXAMPLE 2c-1 | 39 | 240 | 0.3 | 46.7 | BAD |

TABLE 4-continued

| Charging Roller ϕ14 mm, Photoreceptor ϕ30 mm | | | | | |
|---|---|---|---|---|---|
| | CHARGING ROLLER | | | | |
| | RUBBER HARDNESS (DEGREE) | APPLIED LOAD (gf) | NIP WIDTH (mm) | ROLLER DIAMETER/NIP WIDTH | BLACK STREAK |
| EXAMPLE 2c-1 | 35 | 240 | 0.33 | 42.4 | GOOD |
| EXAMPLE 2c-2 | 31 | 240 | 0.36 | 38.9 | GOOD |
| EXAMPLE 2c-3 | 39 | 500 | 0.43 | 32.6 | GOOD |
| EXAMPLE 2c-4 | 35 | 500 | 0.48 | 29.2 | GOOD |
| EXAMPLE 2c-5 | 31 | 500 | 0.52 | 26.9 | GOOD |
| EXAMPLE 2c-6 | 39 | 1000 | 0.61 | 23.0 | GOOD |

In the "BLACK STREAK" column in Tables 2 through 4, "GOOD" indicates that no black streak occurred at all. "FAIR" indicates that a black streak occurred slightly. "BAD" indicates that a black streak occurred.

The results obtained from the Experiment explained above suggest that it is preferable for prevention of an occurrence of a black streak that a value of external diameter/nip width of the charging roller 2 is less than 45. It is more preferable that the value of external diameter/nip width of the charging roller 2 is 43.8 or less.

Moreover, it is also suggested that a smaller rubber hardness makes it possible to secure a sufficient gripping force better even under a small load applied and, consequently, to prevent the occurrence of a black streak.

Experiment 3

Next, a relationship between a maximum height of the profile Rmax of a surface of a rubber layer 22 and the occurrence of a fog was examined by using charging rollers 2 and a photoreceptor 1 which were produced in the same method as in the Experiment 1. In this Experiment, each of the charging rollers 2 that had different maximum heights of the profiles Rmax on their respective surfaces was arranged so as to be in contact with the photoreceptor 1. Then, image formation was performed on a sheet of paper at a processing speed of 395 mm/sec while a direct current constant voltage was applied to the charging roller 2. Then, it was examined by visual observation whether or not a black streak had occurred in an image formed. During the image formation, a lubricant made of zinc stearate was applied to the photoreceptor 1 at 30 μg/A4.

Table 5 below shows conditions, in other words, a maximum height of the profile Rmax of the surface of the rubber layer 22 and a corresponding ten-point height of irregularities Rz, in each of the Examples and the Comparative Examples. The ten-point height of irregularities Rz and the maximum height of the profile Rmax were measured by a tracer-type surface roughness tester.

As a result, as illustrated in the Table 5, a fog conspicuously occurred when the maximum height of the profile Rmax of the surface of the rubber layer 22 was 27.5. The fog occurred slightly when the maximum height of the profile Rmax of the surface of the rubber layer 22 was 25.8. Moreover, no fog occurred at all when the maximum height of the profile Rmax of the surface of the rubber layer 22 was 24.2 or less.

TABLE 5

| | CHARGING ROLLER | | |
|---|---|---|---|
| | Rz (μm) | Rmax (μm) | FOG |
| EXAMPLE 3-1 | 17.6 | 20.0 | GOOD |
| COMPARATIVE EXAMPLE 3-1 | 20.0 | 27.5 | BAD |
| EXAMPLE 3-2 | 20.8 | 25.8 | FAIR |
| EXAMPLE 3-3 | 20.3 | 24.2 | GOOD |
| EXAMPLE 3-4 | 20.0 | 22.9 | GOOD |

In the "FOG" column in Table 5, "GOOD" indicates that no fog occurred at all. "FAIR" indicates that a fog occurred slightly. "BAD" indicates that a fog occurred conspicuously.

The results obtained form the Experiment suggests that it is preferable for prevention of the occurrence of the fog that the maximum height of the profile Rmax of the surface of the rubber layer 22 is set to less than 25.8 μm. It is more preferable that the maximum height of the profile Rmax of the same is set to 24.2 μm or less. Moreover, the result obtained form the Experiment also suggests that, provided that this condition is satisfied, no fog occurs even when the ten-point height of irregularities Rz is slightly larger than 20 μm.

The present technology is not limited to the description of the embodiments and the examples above, but may be modified by a skilled person within the scope of the claims. An embodiment based on a proper combination of technical means disclosed in different embodiments is encompassed in the technical scope of the present technology.

Moreover, needless to say, a numerical range other than the numerical range described in the present specification is included in the present technology as long as it is a rational range which does not go beyond the spirit of the present technology.

As mentioned above, in an image forming apparatus and a process cartridge incorporating the technology, the surface of the rubber layer of the charging roller is arranged to have a ten-point height of irregularities Rz of 11 μm or more. As explained above, this makes it possible to prevent the occurrence of a defective image due to a slip of the charging roller, in an image forming apparatus where the charging roller charges an image carrier to which a lubricant is applied.

It is preferable that the surface of the rubber layer has a ten-point height of irregularities Rz of less than 20 μm. Alternatively, the surface of the rubber layer may have a maximum height of the profile Rmax of less than 25.8 μm.

The "maximum height of the profile Rmax" herein is the one defined in JIS-B-0601-1982.

When the surface of the rubber layer has a large Rmax value, there are protrusions partially (in a spotty manner) on the surface. Accordingly, the charging roller cannot charge the image carrier uniformly. This produces a small spot strongly charged on the image carrier. As a result, a fog occurs in an image formed. In such a case, if the ten-point height of irregularities Rz of the surface of the rubber layer is suppressed to less than 20 μm, or the maximum height of the profile Rmax of the surface of the rubber layer is suppressed to less than 25.8 μm, the protrusions produced in a spotty manner become small. This makes it possible to prevent the fog.

It is preferable that the surface of the rubber layer is hardened with a solution containing an isocyanate compound.

According to this arrangement, a desired hardness of the surface of the rubber layer can be secured without another surface layer additionally provided around the rubber layer. This can prevent a substance (such as an ionic conductive agent) contained in the rubber layer from seeping from the surface and contaminating the image carrier.

Moreover, it is preferable that the surface of the rubber layer has a JIS-A hardness of 35° or lower.

If the surface of the rubber layer has a high hardness, a sufficient nip cannot be obtained. This causes a shortage of gripping force. Consequently, a slip between the charging roller and the image carrier tends to occur. However, by arranging the rubber layer so that the surface thereof has a hardness of 35° or less, it becomes possible to have a sufficient gripping force even under a small load applied. As a result, the occurrence of a black streak can be further suppressed.

Furthermore, it is preferable that the rubber layer is a hollow cylinder; and a following equation (1) is satisfied $$D/W<45 \quad (1)$$

where W is a nip width that is a contact width between the rubber layer and the image carrier and D is an external diameter of the rubber layer.

D/W shows a length of an external diameter of the charging roller per unit length of the nip width. The larger the nip width is, the larger contact area between the charging roller and the photoreceptor becomes. Therefore, the larger nip width makes it possible to reduce the occurrence of a slip. However, the larger the diameter of the charging roller becomes, the larger inertia force of the charging roller during rotation becomes. As a result of this, a slip is likely to occur. With the nip width W set so that D/W is less than 45, it becomes possible to obtain a sufficient nip width. Consequently, this makes it possible to preferably prevent the slip regardless of the external diameter of the charging roller.

The charging roller may be subjected to application of a direct current constant voltage when the charging roller charges the image carrier.

The application of the direct current constant voltage during image formation for uniformly charging the image carrier is advantageous for reduction of the occurrence of byproducts such as ozone. On the other hand, the application of the direct current constant voltage is disadvantageous in that a black streak in an image tends to occur due to a slip. However, the charging roller in an image formation apparatus has a rubber layer whose surface is arranged to have a roughness adjusted as mentioned above. Accordingly, it becomes possible to prevent the occurrence of a slip and a black streak caused by the slip even when a voltage applied to the charging roller is a direct current constant voltage.

The image carrier and the charging roller may be driven to rotate at a circumferential speed of 280 mm/sec or more, when an image is formed.

The circumferential speed of the image carrier being driven to rotate is the same as a processing speed which is an indicator of a speed of image forming processing. A high image forming processing becomes possible when the circumferential speed is 280 mm/sec or more as mentioned above. Generally, an increased processing speed as mentioned above tends to cause a slip between the charging roller and the image carrier. However, the charging roller in an image forming apparatus has a rubber layer whose surface is set to have a roughness as mentioned above. Accordingly, it is possible to prevent an occurrence of a slip and a black streak due to the slip.

It is preferable that the rubber layer is subjected to lapping. More specifically, it is preferable that the rubber layer is subjected to at least two abrading processes including stone grinding and lapping.

The lapping is added to a conventional abrading process so that only the maximum height of the profile Rmax is reduced while the ten-point height of irregularities Rz is maintained. This makes it easy to arrange the surface of the rubber layer so that the ten-point height of irregularities Rz becomes 11 μm or more and the maximum height of the profile Rmax becomes less than 25.8 μm.

It is possible to prevent a slip of the charging roller in an image formation apparatus where the charging roller charges the image carrier to which a lubricant is applied. Therefore, the present technology can be preferably applied to an electrophotographic image forming apparatus.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of the present technology, provided such variations do not exceed the scope of the patent claims set forth below.

What is claimed is:

1. An image forming apparatus, comprising:

an image carrier to which a lubricant is applied; and a charging roller which includes a rubber layer whose surface contacts the image carrier, wherein the surface of the rubber layer has a ten-point height of irregularities Rz of 11 μm or more, and a maximum height of the profile Rmax of less than 25.8 μm.

2. The image forming apparatus as set forth in claim 1, wherein the surface of the rubber layer has a ten-point height of irregularities Rz of less than 20 μm.

3. The image forming apparatus as set forth in claim 1, wherein the surface of the rubber layer has a maximum height of the profile Rmax of more than 20.0 μm and less than 25.8 μm.

4. The image forming apparatus as set forth in claim 1, wherein the surface of the rubber layer is hardened with a solution containing at least an isocyanate compound.

5. The image forming apparatus as set forth in claim 1, wherein the surface of the rubber layer has a JIS-A hardness of 35° or lower.

6. The image forming apparatus as set forth in claim 1, wherein the rubber layer is a hollow cylinder; and a following equation (1) is satisfied:

$$D/W<45 \quad (1)$$

where W is a nip width that is a contact width between the rubber layer and the image carrier and D is an external diameter of the rubber layer.

7. The image forming apparatus as set forth in claim 1, wherein the charging roller is subjected to application of a direct current constant voltage when the charging roller charges the image carrier.

8. The image forming apparatus as set forth in claim 1, wherein the image carrier and the charging roller are driven to rotate at a circumferential speed of 280 mm/sec or higher, when an image is formed.

9. The image forming apparatus as set forth in claim 1, wherein the rubber layer is subjected to lapping such that the surface of the rubber layer has a ten-point height of irregularities Rz of greater than 11 μm, while the maximum height of the profile Rmax remains below 25.8 μm.

10. The image forming apparatus as set forth in claim 9, wherein the rubber layer is subjected to at least two abrading processes including stone grinding and lapping.

11. The image forming apparatus as set forth in claim 1, wherein the rubber layer is subjected to at least two abrading processes including a stone grinding process that produces the ten-point height of irregularities Rz of greater than 11 μm, and a lapping process that produces the maximum height of the profile Rmax below 25.8 μm.

12. A process cartridge attached to an image forming apparatus comprising:

an image carrier to which a lubricant is applied; and a charging roller which includes a rubber layer whose surface contacts the image carrier, wherein the surface of the rubber layer has a ten-point height of irregularities Rz of 11 μm or more and a maximum height of the profile Rmax of less than 25.8 μm.

13. A production method of a charging roller including a rubber layer whose surface contacts an image carrier to which a lubricant is applied, the production method comprising:

a step of subjecting a surface of the rubber layer to stone grinding so that the surface of the rubber layer has a ten-point height of irregularities Rz of 11 μm or more, and a step of subjecting the surface of the rubber layer to lapping after the stone grinding step so that the surface of the rubber layer has a maximum height of the profile Rmax of less than 25.8 μm.

* * * * *